US005125652A

United States Patent [19]

Davis

[11] Patent Number: 5,125,652

[45] Date of Patent: Jun. 30, 1992

[54] BILLIARD SELF-TEACHING APPARATUS

[76] Inventor: Julius C. Davis, 1220 Zapata Pl., Lady Lake, Fla. 32159

[21] Appl. No.: 754,931

[22] Filed: Oct. 21, 1991

[51] Int. Cl.[5] ..... A63D 15/00

[52] U.S. Cl. ..... 273/2

[58] Field of Search ..... 273/2, 14, 23, 24

[56] References Cited

U.S. PATENT DOCUMENTS

| | | | |
|---|---|---|---|
| 2,708,577 | 5/1955 | Bunka | 273/2 |
| 3,220,122 | 11/1955 | Miller | 273/14 |
| 3,299,537 | 1/1967 | Franks | 273/14 |
| 3,410,555 | 11/1968 | Murch | 273/2 |
| 3,411,779 | 11/1968 | McGowan | 273/2 |
| 3,724,849 | 4/1973 | Pierce | 273/2 |
| 3,947,026 | 3/1976 | Scoutten | 273/2 |
| 3,993,305 | 11/1976 | Nicholson | 273/2 |
| 4,120,494 | 10/1978 | Roe | 273/2 |
| 4,151,990 | 5/1979 | Josenhans | 273/2 |
| 4,173,694 | 12/1979 | Bonney | 273/14 |
| 4,183,523 | 1/1980 | Hatch | 273/2 |
| 4,268,033 | 5/1981 | Fontaine | 273/2 |

FOREIGN PATENT DOCUMENTS

| | | | |
|---|---|---|---|
| 323795 | 1/1930 | United Kingdom | 273/2 |

*Primary Examiner*—Theatrice Brown

*Attorney, Agent, or Firm*—George J. Seligsohn

[57] ABSTRACT

A billiard self-teaching apparatus is comprised of a prison shaped pool cue guide vertically mounted on a folding rectangular shaped base support structure which is comprised of three hinged panels, whereby it can be folded into a transportable position. The pool cue guide has a plurality of pool cue guide slots therein for receiving and directing the arm of a pool cue stick. The position of each guide slot teach a person where to target the aim of a pool cue stick while preparing to execute a forward thrust and a follow-through stroke. A plurality of guide lines are placed upon the base support structure such that they are aligned with a guide slot in the pool cue guide so a person can align his pool cue parallel with a guide line before thrusting the pool cue forward and into a guide slot.

7 Claims, 2 Drawing Sheets

BILLIARD SELF-TEACHING APPARATUS

BACKGROUND

1. Field of Invention

Figure 1:
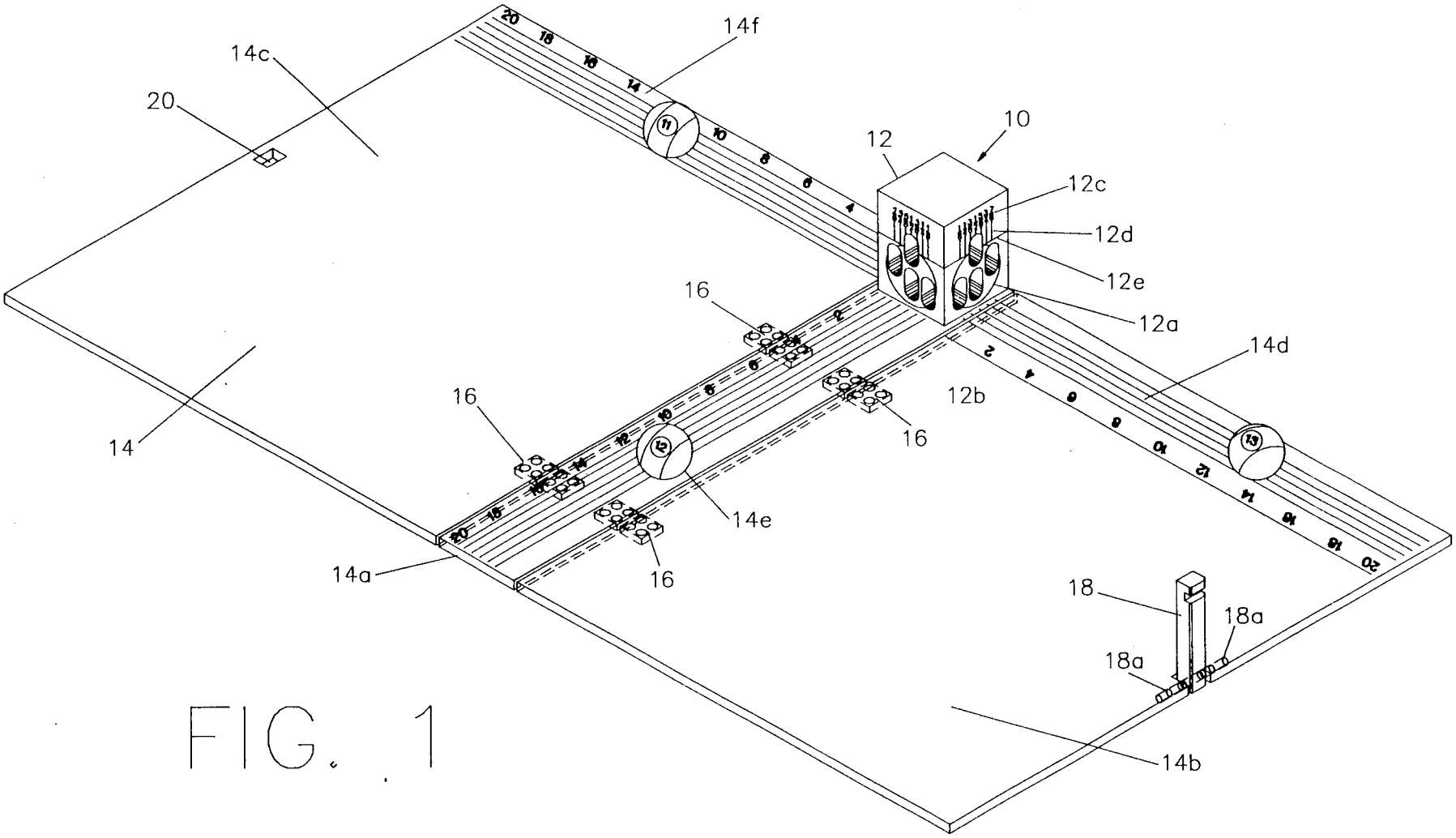

This invention relates to a Folding Desk-Top Billiard Self-Teaching Machine that successfully teach a person to play billiards from use of one's muscle-memory, imagery-memory, sight-memory and feeling-memory.

2. Description of Prior Art

Since the mid 1900s, the sport of billiards has enjoyed an escalation of vigor after a period of obscurity. A study, researched by the National Sporting Goods Association (NSGA), showed that 29.6 million people, 7 years and older, participated in the sport of billiards, more than once, in the U.S.A. during 1989. In this study, billiard's placed eighth in a list of 20 sport participating categories. In effort to capitalize on the escalating, energetic, living billiard population market, inventors, in hope of making billiard's easier to learn, have attempted since early 1950's to invent a billiard machine that could be used in teaching certain fundamental techniques of billiard's, for example:

(1) U.S. Pat. No. 4,268,033, to Fontain (1980), discloses a Cue Ball Aiming device.

(2) U.S. Pat. No. 4,151,990 to Josenhans, (1977), discloses a Billiard Aiming Guide.

(3) U.S. Pat. No. 3,993,305, to Nicholson (1975), discloses a Pocket Billiard Training Ball, and Method of Teaching Sighting When Playing Pocket Billiards.

(4) U.S. Pat. No. 3,947,026, to Scoutten (1975), discloses a Billiard Training Device.

(5) U.S. Pat. No. 3,728,849, to Pierce (1971), discloses a Billiard Training Apparatus.

(6) U.S. Pat. No. 3,411,779, to McGowan (1979), discloses a Aiming Point Indicator for Billiards.

(7) U.S. Pat. No. 3,410,555, to Murch (1965), discloses a Cue Ball Aiming Device.

(8) U.S. Pat. No. 2,708,577, to Bunka (1954), discloses a Cue Practising Machine.

With the exception of the Cue Practising Machine (8) each of these inventions have certain specific application requirements that are so predominately significant and incompatible for use by men, women, children and the physically impaired that they have not come into any appreciable demand. The Cue Practising Machine (8) requires a special designed flat table with a slot in the top through which a mechanized, operated pin projects. It can be seen that the Cue Practising Machine (8) cannot be used conveniently or effectively by small children and the physically impaired. Note, that this unit has no height adjustment mechanism to lower and raise the table level for use by children and the physically impaired.

Aside from the above, each of the present inventions suffer from a number of disadvantages:

(a) In order to operate effectively, each of these inventions, (1) through (7), is specifically designed to "operate" in an environment in which a billiard table is available for practice.

(b) In order to operate effectively, each of these inventions (1) through (7), require the use of a regulation size cue ball to be used in conjunction with a billiard table.

(c) People who do not own a billiard table or have access to a facility in which a billiard table is available for individual practice, find the addition of a billiard table and a cue ball requirement not only to be an economical hardship, but also a participant inconvenience.

(d) Consequently, these requirements have restrained the interest and use of these inventions by the majority of the billiard population, especially the physically impaired, the children, and the women.

(e) A fifth disadvantage suffered by each of these inventions, (1) through (7), is the requirement that they be precisely positioned for operation on the surface of a billiard table so that a person can effectively accomplish a particular billiard fundamental technique. Thus, this requirement discouraged, and further restrained the interest and use of these inventions by the majority of the billiard population.

(f) A sixth disadvantage, suffered by each of these inventions is that they are designed to "operate" by moving, mechanical parts which require adjustment and alignment before a person can begin to effectively perform a particular billiard fundamental technique.

(g) Consequently, the physically impaired, the women, and the children find these inventions to be too difficult to operate and control.

OBJECTS AND ADVANTAGES

My own invention is specificially designed with a built-in self-teaching capability that successfully teach and cause a person to learn by example and experience how to play billiards within four one-half practice sessions from use of one's muscle-memory, imagery-memory, sight-memory and feeling-memory. Besides the objects and advantages of my invention described above, it successfully provides several additional objects and advantages that are strikingly new, unobvious and are not present in any, one prior-art references:

(a) to provide a invention that is both new and unobvious, and to demostrate that it can successfully operate without the use of a billiard table or a billiard ball. My invention is used by placing it parallel to the top of any supported flat surface such as a kitchen table, or on a dresser top, or on the top of any similar shaped, designed object. Practice is performed by merely stroking a cue-stick shaft repetitiously through one of four elongated slots located within each of the three faces of the invention;

(b) to provide a invention that operates without a cue ball used in conjunction with a billiard table;

(c) to provide a invention that is economically feasible to purchase, and is convenient for operating and use by the billiard population; especially the physically impaired, the children and the women;

(d) to provide a invention that is strikingly new, unobvious and is exciting to operate in a home environment by the total billiard population;

(e) to provide a invention that has a built-in self-teaching capability, and a preciseness and a reliability that is independent of internal and external source of mechanical power;

(f) to provide a invention that successfully operates without moving, mechanical parts, and requires no internal or external adjustment and alignment prior to its selected purpose of operation;

(g) to provide a invention that has a novel, built-in, ease-of-use capability that previously was unknown and not appreciated by the billiard population.

Further objects and advantages are to provide a billiard self teaching apparatus which:

(1) successfully demonstrates that it can solve a long felt, long existing need, in the sport of billiards, to teach a person precision stroking, aiming, sighting, and the controlled feeling of follow-through, (2) successfully demonstrates that it can be conveniently folded into a transportable position, and hand carried from a home environment to an office environment, to a hotel environment, and to a school environment, (3) successfully demonstrates that it can be easily and conveniently used by one to three persons practicing at the same tome, and, (4) being a self-contained apparatus, one which (5) successfully demonstrates that it requires no repairs. each of which, (1) through (5) certifies its opportunity and potentiality to demand a high dollar mark-up in the billiard sport economy through-out the 21st Century.

Still further objects and advantages will become apparent from a consideration of the enusing description and drawings.

DRAWING FIGURES

Because the invention is customarily seen and used in the front position, as illustrated by FIG. 1, of the drawing, it will be noted that the invention is seen in its principal, normal operational position. Seen from this position, it will also be noted that there is a great deal of repetition of information in the front, right and left view of drawing FIG. 1, that is, the adjacent views are reciprocal. For this reason, the left side view is not shown, and will not be specifically described in the specification because the right side view of prism shaped module 12, is the reciprocal of the front view; consequently each view describes reciprocal information required in the left side view. However, it is necessary to focus attention to the omission of the left side of prism shaped module 12, whenever clarity is appropriate. Furthermore, it is readily perceived that all related reference numerals have the same number, but different suffixes.

FIG. 1 is a isometric projection drawing illustrating a folding desk-top billiard self-teaching apparatus 10, and a prism shaped module 12, glue mounted onto a flat, rectangle shaped platform 14.

Figure 2:
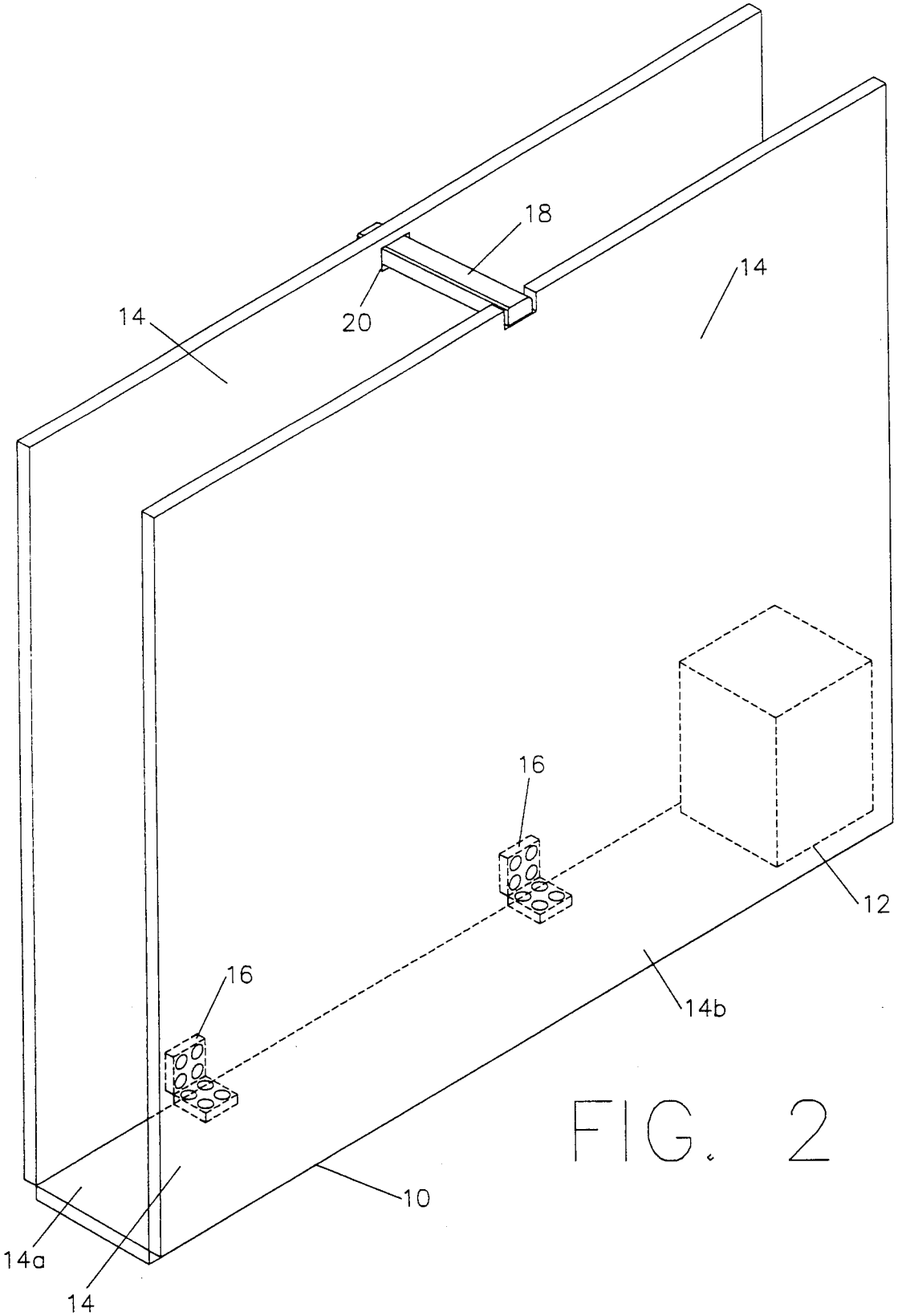

In a second illustration of the invention, FIG. 2 is a isometric projection drawing, in which folding desk-top billiard self-teaching apparatus 10, is shown in a folded, hand-carried, transportable position.

REFERENCE NUMERALS IN DRAWINGS

10: billiard self-teaching apparatus
12: prism shaped module
14: rectangle shaped folding platform
16: hinge
18: carrying handle
20: locking slot

DESCRIPTION—FIG. 1 AND FIG. 2

A typical embodiment fof the present invention is illustrated in FIG. 1. A folding desk-top billiard self-teaching apparatus 10, comprises a prism shaped module 12, glue-mounted onto the top surface of a rectangle, shaped folding platform 14. In the front and right-side view of prism module 12, symmetrically aligned at each right and left side, and above and below the axis of a circumscribed circle 12*a*, appears elongated vertical guide slots 12*b*.

Above the top of circumscribed circle 12*a*, inscribed on each of prism module 12, apprears equally spaced embossed, numerical fractional values 12*c*, accompanied, respectively by equally spaced, embossed vertical guide lines 12*d* of which extend therethrough the perimeter of circumscribed circle 12*a*; and, finally terminates at the base line adjoining prism module 12, with rectangle platform 14. Note that the features of the left side view of FIG. 1 are not illustrated in the drawing; therefore, they cannot be represented in this specification. It should also be noted that embossed fractional value 12*c*, and embossed vertical guide lines 12*d*, and embossed horizontal line 12*e* may be inscribed with black paint.

Rectangle platform 14 supports prism module 12, adjacent to the rear edge of rectangle platform 14, at mid panel 14*a*, and between right side panel 14*b* and left side panel 14*c*. Beginning at the base line, adjoining rectangle platform 14, with prism module 12, appear three sets of five inscribed horizontal parallel guide lines 14*d*, of which extend to the extreme edges of rectangle platform 14. A black and white, photo copy of a billiard ball 14*e*, is super-imposed over five horizontal parallel guide lines 14*d*. Adjacent to the left of five horizontal parallel guide lines 14*d* appear a 20 inch, inscribed, graduated ruler 14*f*.

In a second embodiment of the invention, FIG. 2, illustrates folding desk-top billiard self-teaching apparatus 10, in a folded, hand transportable position; that is, with right side panel 14*b* and left side panel 14*c*, attached to mid panel 14*a* with four hinges 16; folding desk-top billiard self-teaching apparatus 10, is folded into a locked position by inserting hand carrying handle 18, into locking slot 20; pin 18*a* serves as a support to which carrying handle 18 is fastened onto panel 14*b*.

OPERATION—FIG. 1 AND FIG. 2

Folding desk-top billiard self-teaching apparatus 10 (FIG. 1) is specifically designed with certain built-in learning capabilities that teach by user application the fundamental techniques of billiard skill within four one-half hour practice sessions.

Folding desk-top billiard self-teaching apparatus 10, is used by placing it parallel to the top of any supported flat surface such as a kitchen table, or on a dresser top; or on the top of any similar shaped designed object. Practice is performed by merely stroking a cue stick shaft repetitiously through one of the four (4) vertical elongated guide slots 12*b* located within each face of prism module 12 (FIG. 1). FIG. 1 shows that guide slots 12*b* are specifically arranged, at each side and above and below the axis of a circumscribed circle 12*a*, to guide a billiard player's cue stick shaft therethrough each of four guide slots 12*b* located within each face of prism module 12. Circumscribed circle 12*b* represents a visual image of a 2¼ inch regulation size object billiard ball, and is inscribed on each face of prism module 12 (FIG. 1) to aid in programming the visual memory of a person, during practice with billiard self-teaching apparatus 10, and to transfer and to superimpose onto the surface of an actual object billiard ball the same exact visual image inscribed on each face of prism module 12 (FIG. 1).

The specific arrangement of elongated guide slots 12*b* (FIG. 1) provide a target area within each face of prism module 12 and are intended to simulate the image of a regulation size object billiard ball; whereby, a billiard player stroking a cue stick shaft, can select the slot that corresponds to his level of skill in billiards. For example, cue stick to the left, right, top or bottom of a imaged billiard ball inscribed on each face of prism module 12 (FIG. 1). Thus, a player learns simultaneously how to accurately aim at an object billiard ball and how to stroke and follow-through with a cue stick shaft. It will be noted that while this invention facilitates use by three persons, practicing simultaneously, it can be designed to facilitate use by one through eight persons or more.

The arrangement of guide slots 12*b* (FIG. 1) also provide for a sufficiently large opening so that beginners and the physically impaired can either sit upon a chair or a bench, and practice stroking their cue stick shaft in a horizontal motion through guide slots 12*b*; or even stand and stroke their cue stick shaft at an elevated angle through guide slots 12*b*. Furthermore, the position of guide slots 12*b* demonstrate to a billiard palyer how to use these guide slots to master the technique of a billiard follow-through stroke by actually stroking the cue stick shaft repetitiously, through each guide slots 12*b*.

Above the top of circumscribed circle 12*a*, inscribed on each face of prism module 12 (FIG. 1) appears seven (7) equally spaced embossed numerical, fractional values 12*c*, of which, measure: $\frac{1}{8}$, $\frac{1}{4}$, $\frac{3}{8}$, $\frac{1}{2}$, $\frac{5}{8}$, $\frac{3}{4}$ and $\frac{7}{8}$ inch; and are accompanied with seven (7) equally spaced, embossed vertical parallel guide lines 12*d* (FIG. 1) which extend through each face of circumscribed circle 12*a* to the base of prism shaped module 12.

The position of guide slots 12*b* and each of seven numerical fractional values 12*c*, accompanied with vertical parallel guide lines 12*d* (FIG. 1), demonstrate to a billiard player that the surface of a billiard ball can be visually imaged to consist of seven vertical parallel guide lines 12*d* at which a billiard player can direct the aim of a cue stick shaft while preparing to execute a follow-through stroke into each guide slot 12*b*.

It will be noted that while this invention provides for only three of the four (4) congruent faces of prism shaped module 12 (FIG. 1), it could have used all four faces of prism module 12; or, designed to use other geometric shaped: such as, a cube, a cone, a cylinder, a hexagon, or an octagon.

The position of rectangle shaped platform 14 (FIG. 1) is to provide support upon which a billiard player can rest his bridge hand in preparation for executing a billiard stroke and a follow-through into each guide slot 12*b* (FIG. 1).

The position of a set of five horizontal inscribed parallel guide lines 14*d* (FIG. 1) demonstrate to a billiard player how to master the technique of a level, accurate stroke and follow-through by actually stroking the cue stick shaft repetitiously, parallel to horizontal parallel guide lines 14*d*, in preparation for stroking the cue stick shaft therethrough each of guide slots 12*b* (FIG. 1).

In the above description, the novel features of rectangle shaped platform 14, I have exhibited a completely different billiard learning technique that successfully solved a long, felt, long existing, and an unsolved need to provide billiard self-teaching machine 10, that teach a billiard player how to master fundamental billiard techniques within a period of time never before appreciated or accomplished.

The position of a black and white photo copy of a object billiard ball 14*e* (FIG. 1) permanently arranged within the configuration of five horizontal parallel guide lines 14*d*, demonstrate to a billiard player how to accurately line-up the cue stick shaft with the surface area of a visual, imaged cue ball, while preparing to execute a follow-through stroke into guide slots 12*b*.

The position of a inscribed 20 inch graduated ruler 14*f* (FIG. 1) permanently arranged onto the surface of rectangle shaped platform 14, and located to the left of each set of five horizontal parallel guide lines 14*d*, demonstrate to a billiard player how to master a controlled, speed-of-stroke by making certain measured adjustments to the extension of a cue stick shaft, and the position of his bridge-hand, while preparing to execute a follow-through stroke into guide slots 12*b*.

A second manner of using billiard self-teaching machine 10 (FIG. 2) is in a folded, hand transportable position. Right side panel 14*b* and left side panel 14*c* are fasten onto mid panel on 14*a* with hinge 16. Billiard self-teaching apparatus 10 (FIG. 1) is then folded into a locked position by inserting a hand carrying handle 18 into a locking slot 20; carry handle 18 is made mobile by pin 18*a* which is fastened onto panel 14*b*.

These additional features further distinguishes my invention as novel in application and function, and provides an advantage of my invention by employing the art of visual imagery to aid in learning and teaching the sport of billiards.

In this feature, I provided a strinkingly new teaching technique of precision aiming and sighting at the surface of an object, billiard ball; by aiming and sighting at guide slots 12*b*, and numerical fractional values 12*c*, and vertical parallel guide lines 12*d*, a billiard player can now acquire a new technique of precision aiming and sighting. Each time a billiard player elects to practice with billiard self-teaching apparatus 10 (FIG. 1), the visual image of guide slots 12*b*, and fractional values 12*c*, and vertical parallel guide lines 12*d* (FIG. 1) are programmed into his visual memory. After four fifteen minutes practice sessions, a billiard player will be able to successfully superimpose the visual images of guide slots 12*b*, and numerical fractional values 12*c*, and vertical parallel guide lines 12*d* onto the surface of an actual object, billiard ball.

The fact that prism module 12, and rectangle shaped platform 14 (FIG. 1) are designed to function as a system, and can be used by three persons at the same time, successfully provide another advantage that distinguish it as novel in appearance and function; this function and appearance is another feature that makes it completely different from other inventions, of this purpose, commonly in use at the present time.

It is important to point out that my invention can be of any shape, size or weight. But, in a preferred form (FIG. 1) its total weight is approximately 3.63 kg; in its open, practice position (FIG. 1) it will measure approximately 109 cm long by 66 cm wide; in its non-operation position (FIG. 2) it will fold into a portable, hand carried, billiard self-teaching apparatus 10 that measures approximately 51 cm high by 66 cm wide by 10 cm thick. The material composition can be wood, stainless steel or plastic. In a preferred form it is made of wood.

SUMMARY, RAMIFICATIONS, AND SCOPE

Accordingly, I have successfully illustrated an innovated, strikingly and intriguingly new invention with physical and functional features never before recognized, appreciated, or accomplished in any one prior-art references; moreover, it will be noted that my invention omits certain operation features commonly shown in prior-art references without loss of any advantage it has over any one prior-art references. For example:

it successfully operates without the use of a billiard table and a cue ball. My invention is used by placing it parallel to the top of any supported flat surface, such as: a kitchen table, a dresser top, or on the top of any similar shaped, designed object. Practice is performed by merely stroking a cue stick shaft repetitiously therethrough each guide slot 12*a* through 12*d* located within each face of prism module 12 (FIG. 1).

I successfully provided a invention that is economically feasible to purchase, and is convenient for operating and use in any commercial, industrial or social environment by the billiard population; especially the physically impaired, the children and the women;

I successfully provided a invention that is strikingly and intriguingly new, and is exciting to operate in a home environment by the billiard population;

I successfully provided a invention that has a built-in self-teaching capability, and a preciseness and a reliability that is unmatched, and is independent of internal and external source of mechanical power;

I successfully provided a invention that effectively operates without moving, mechanical parts, and requires no internal or external adjustment, or alignment prior to its purpose of operation;

I successfully provided a invention that has a novel, built-in ease-of-use capability that previously was unknown and not accomplished in any one of the prior-art references.

In addition to the above advantages, my invention successfully demonstrates five new features which provide new and unexpected results: My invention, (1) successfully demonstrate that it can solve a long felt, long existing need, in the sport of billiards, to teach a person precision stroking (muscle memory), aiming (sight memory), and the controlled feeling of follow-through (feeling memory);

(2) successfully demonstrate that it can be conveniently hand carried from a home environment to a commercial, industrial or social environment;

(3) successfully demonstrate that it can be easily and conveniently used by three persons practicing with it at the same time, and (4) being a self-contained, self-teaching maching, it (5) successfully demonstrate that it requires no repairs, and is compatible for use by the total billiard population; all of which (1) through (5) certifies its opportunity and potentiality to demand a high dollar mark-up value in the billiard sport economy through the 21st century.

Although the descriptions above contain many specificities these should not be construed as limiting the scope of my invention but, as merely providing illustrations of some of the presently preferred embodiments of my invention. For example, vertical guide slots 12*b* (FIG. 1) arranged within the face of prism module 12 can have other shapes, such as: a singular, replaceable tubular shaped cylinder with multiple different dimensioned diameters for the hole through-which a person can stroke a cue stick shaft; prism module 12 can have other geometric shapes, such as: oval, cube, sphere, cone, cylinder, pyramid, octagon, hexagon; prism module can also be a replaceable embodiments to rectangle shaped platform 14 (FIG. 1).

Thus, the scope of my invention should be determined by the appended claims and their legal equivalents, rather than the examples given.

I claim:

1. A billiard self-teaching apparatus comprising, a base support structure, said support structure having a predetermined length and width, a pool cue guide having a predetermined length width and height and supported on said base support structure, said length, and width of said pool cue guide being substantially less than the respective length and width of said base support structure, said length, width and height of said pool cue guide defining a plurality of substantially planar vertically extending faces, at least one of said faces having indicia of a circumscribed circle thereon, said circle representing an imaginary billiard ball having a diametrical axis substantially coincident with a vertical line of said at least one face and having a diameter of a regulation size billiard ball, a plurality of substantially horizontally extends slots extending through said pool cue guide, said slots being substantially within said circle and having a sufficient size to freely receive a forward thrust of a regulation billiard pool cue, said base structure further having a first set of parallel spaced apart guide lines extending along one longitudinal edge thereof and a second set of parallel spaced apart guide lines extending substantially perpendicular to said first set of guide lines and extending substantially thereto.

said pool cue guide being placed on said base support structure such that said diametrical axis is substantially in alignment with a centermost guide line of said first and second sets of guide lines, said centermost guide line and at least some of the remaining guide lines being in alignment with a said slot in said pool cue guide, whereby when a player places a pool cue above and in parallel alignment with a guide line, the pool cue will enter one of said guide slots when said cue is thrust forward towards said pool cue guide; and, means representing a billiard ball imposed over at least one set of said guide lines and intermediate the edge of said support structure and said pool cue guide, whereby a player can imagine aiming at a billiard ball while aligning a pool cue stick with one of said guide lines before thrusting the pool cue stick into a specific one of said slots.

2. The billiard self-teaching apparatus as defined in claim 1 wherein, said base support structure is comprised of at least three substantially planar panels, a middle panel and two end panels, hinge means pivotally connecting said end panels to said middle panel to define a foldable base support structure, handle mean on said base support structure for carrying said apparatus when said base structure is in a folded position.

3. A billiard self-teaching apparatus as defined in claim 2, wherein, said pool cue guide is attached to said middle panel.

4. A billiard self-teaching apparatus as defined in claim 1 wherein, measuring means is positioned on said base support structure substantially parallel to said guide lines, whereby a player can determine the distance between the tip of a pool cue and said pool cue guide before thrusting the pool cue towards said pool cue guide.

5. A billiard self-teaching apparatus as defined in claim 4, wherein, said measuring means is a numerically calibrated ruler.

6. A billiard self-teaching apparatus as defined in claim 1, wherein, said slots are vertically elongated, and are symmetrically positioned about the vertical diameter of said circumscribed circle, and, indicia of a plurality of equally spaced numerical fractional values, extend horizontally above said circumscribed circle, each numerical value being accompanied by a corresponding vertically extending line to aid a player in imagining a plane of a billiard ball to be struck by a cue stick as said cue stick is thrust into a said slot.

7. A billiard self-teaching apparatus as defined in claim 1, wherein;

said means representing a billiard ball is a photo-copy of a regulation billiard ball placed over said guide lines and attached to said base support structure.

* * * * *